United States Patent [19]

Nelson et al.

[11] Patent Number: 4,996,848

[45] Date of Patent: Mar. 5, 1991

[54] METHOD AND APPARATUS FOR RECOVERING REFRIGERANTS FROM HOME REFRIGERATION SYSTEMS

[75] Inventors: John A. Nelson, Benton Harbor; Terry L. McGath, Berrien Springs; David B. Kirby, Benton Harbor; Phalguni S. Roy, St. Joseph; John L. Wuepper, St. Joseph; Omer N. Cur, St. Joseph, all of Mich.

[73] Assignee: Whirlpool Corporation, Benton Harbor, Mich.

[21] Appl. No.: 413,823

[22] Filed: Sep. 28, 1989

[51] Int. Cl.[5] ..... F25B 45/00

[52] U.S. Cl. ..... 62/77; 62/292; 141/10; 141/65; 141/114; 53/431; 53/434

[58] Field of Search ..... 62/77, 149, 292; 141/10, 65, 114; 53/79, 403, 431, 434, 512

[56] References Cited

U.S. PATENT DOCUMENTS

| | | | |
|---|---|---|---|
| 2,764,859 | 10/1956 | Hanselmann | 53/434 |
| 3,232,070 | 2/1966 | Sparano | 62/77 X |
| 3,892,058 | 7/1975 | Komatsu et al. | 53/434 X |
| 4,363,222 | 12/1982 | Cain | 62/149 X |
| 4,364,236 | 12/1982 | Lower et al. | 62/77 |
| 4,476,688 | 10/1984 | Goddard | 62/149 |
| 4,513,578 | 4/1985 | Proctor et al. | 62/149 |
| 4,768,347 | 9/1988 | Manz et al. | 62/149 |
| 4,776,174 | 10/1988 | Rich et al. | 62/77 |

OTHER PUBLICATIONS

Robert Bosch Hausgerate GmbH (ZKD 51 4161 6902-003 M)(w/English Translation) Linde AG Publication (85502-0987-3.10PE).

Distriparts Sweden AB Publication No. 599 25 04-19/4, Bauknecht Brochure and Related Bauknecht Press Information Publications, Nutec Corporation Brochre (printed 1/82).

Pollution Measurements Corporation Brochure (undated).

Official Gazette, Aug. 30, 1988, publication of U.S. Pat. No. 4,766,733 Robinar publication SA372 Rev. 1/89.

Article from *Air Conditioning, Heating and Refrigeration News*, 8/21/89.

Article from *Wall Street Journal*, Sep. 6, 1989.

*Primary Examiner*—William E. Tapolcai

*Attorney, Agent, or Firm*—Wood, Phillips, Mason, Recktenwald & VanSanten

[57] ABSTRACT

There is disclosed herein a refrigerant container in the form of a bag, or pouch, made from two sheets of multilayer barrier film material which are heat sealed adjacent their edges to form a closed pouch which has an interior space. The bag may be connected to an access valve provided in a line of a sealed refrigeration system for capturing the refrigerant therefrom. The barrier film material is specially formulated to prevent outward permeation of a refrigerant and to prevent inward permeation of air. A valve stem is provided for filling and emptying the bag.

13 Claims, 3 Drawing Sheets

METHOD AND APPARATUS FOR RECOVERING REFRIGERANTS FROM HOME REFRIGERATION SYSTEMS

FIELD OF THE INVENTION

This invention relates to refrigeration apparatus and, more particularly, to an improved method and apparatus for recovering refrigerants therefrom.

BACKGROUND OF THE INVENTION

Refrigeration apparatus, such as refrigerators, freezers, dehumidifiers and air conditioners, include a sealed refrigeration system for providing cooling. A typical system includes a compressor, a condenser and an evaporator with intermittent recirculation of a refrigerant or coolant to provide cooling. A typical refrigerant used in refrigerators and freezers is known as R-12, while a typical refrigerant used in air conditioners is known as R-22.

Both of the above-mentioned refrigerants include chlorofluorocarbons (CFCs). In servicing refrigeration apparatus at the present time, CFCs are customarily released to the atmosphere. However, CFCs are believed to deplete the ozone layer from the atmosphere. This damages the atmosphere since the ozone layer filters harmful ultraviolet radiation from sunlight.

Occasionally, it is necessary to remove the refrigerant from a sealed system. For example, if a compressor needs to be replaced, or if there is an improper charge in the system, or if there is a flow restriction in the sealed system, then it is necessary for a service technician to evacuate the refrigerant from the sealed system prior to servicing. One commonly used method uses a long hose connected to a valve brazed on a line of the sealed system to purge the refrigerant either directly into the home, or outside the home. However, this procedure has caused concern among environmentalists as a result of its harmful effects to the ozone layer.

Various apparatuses are available for capturing the refrigerant removed from a sealed system. Examples of refrigerant recovery and capture devices are disclosed in Cain U.S. Pat. No. 4,261,178 and Lower et al. U.S. Pat. No. 4,441,330. However, these disclosed devices are believed to be heavy, bulky, complicated and expensive. In a recently reported survey, the available equipment for refrigerant recovery/recycling weighed from 40 to 600 lbs with an average weight of close to 150 lbs. The cost of such equipment varied from a low of $1,200 to as high as $24,000. While large repair shops may easily justify such expense, refrigerant recovery is not performed often enough for most small repair shops to justify the cost of purchasing or acquiring the expertise to correctly use such equipment.

The present invention is directed to solving one or more of the problems set forth above, in a novel and simple manner.

SUMMARY OF THE INVENTION

In accordance with the present invention, a method and apparatus is provided for simply and inexpensively recovering refrigerants from a sealed system.

Broadly, there is disclosed herein an apparatus for capturing a refrigerant contained in a sealed, pressurized refrigeration system and which may be provided with an access valve on a refrigerant line of the system. The apparatus includes a refrigerant container comprising a plastic bag or pouch of a film material to define an interior space at atmospheric pressure, the film material being substantially inert and impervious to the refrigerant, compressor oil, and contaminants that may be found in a failed sealed system. Such contaminants mainly consist of acids, non-condensable gases, moisture and particulate matter. An opening is provided through the film material providing an inlet to the interior space. Means are provided for connecting the bag at the opening thereof to an access valve to permit the refrigerant to escape under pressure from the refrigeration system to the interior space of the bag.

It is a feature of the invention that the connecting means comprises a flexible hose connected between the access valve and the plastic bag.

It is another feature of the invention that the plastic bag is of a transparent material permitting inspection of the contents of the refrigerant captured therein.

It is a further feature of the invention that a desiccant, an alkali material, an active metal such as powdered iron and/or charcoal may be provided in the interior space of the plastic bag prior to or subsequent to capture of the refrigerant for interaction with the recovered contents in the plastic bag refrigerant container as a first step in purifying the refrigerant.

It is yet another feature of the invention that the connecting means comprises an adapter fitting secured to the plastic bag refrigerant container at the opening for connecting to the access valve.

It is an additional feature of the invention that the bag is comprised of laminate film material and having an adapter fitting assembled to one face of the disclosed bag or pouch.

According to another aspect of the invention, a system is provided for capturing refrigerant contained in a sealed, pressurized refrigeration system. The system includes an access valve for connection to a refrigerant line of the refrigeration system, and a plastic bag of laminate film material to define an interior space at atmospheric pressure, the film material being substantially inert and impervious to the refrigerant, compressor oil and sealed system contaminants. An opening is provided through the film material providing an inlet to the interior space for containing the refrigerant, etc. An adapter fitting is secured to the film at the inlet opening. A flexible hose is provided for connecting the adapter fitting to the access valve to permit the refrigerant to escape under pressure from the refrigeration system to the interior space of the bag.

More specifically, there is disclosed herein a bag, or pouch, made from a multi-layer barrier film material sealed to form a closed pouch having an interior space. The barrier film material is specially formulated and fabricated to prevent outward permeation of the refrigerant and to prevent inward permeation of air. A bulkhead fitting is provided for filling and emptying the bag.

The film material is also formulated to give very high elongation under stress, so that the pouch can hold a larger than designed volume. Further, the formulation allows for a non-explosive rupture if too much refrigerant is introduced into the pouch.

The bag is advantageously connected to the refrigeration system by a flexible hose. The highly pressurized liquid refrigerant boils out of the refrigeration system and escapes into the bag as a gas. The compressor in the sealed system may also be energized to pump the refrigerant into the pouch. When the refrigeration system has been emptied, the refrigerant in the bag may be purified and reused, or disposed of in an environmentally safe manner.

In accordance with another aspect of the invention, a method is disclosed for capturing refrigerant contained in a sealed, pressurized refrigeration system. The method comprises the steps of attaching an access valve to a refrigerant line in the system, connecting a plastic bag to the access valve, the bag being at atmospheric pressure and of a material substantially inert to the refrigerant, compressor oil and sealed system contaminants, opening the valve to permit the refrigerant to escape under pressure from the system into the bag, and subsequently closing the access valve, removing the bag from the access valve, and sealing the bag to prevent the captured refrigerant from escaping.

A typical refrigeration system includes a compressor having a high pressure side and a low pressure side. In accordance with the invention, if the compressor is operable, then the access valve is attached to the high pressure side of the compressor so that the compressor may act as a pump to remove the refrigerant from the system.

Further features and advantages of the invention will readily be apparent from the specification and from the drawings.

DESCRIPTION OF THE INVENTION

Figure 1:
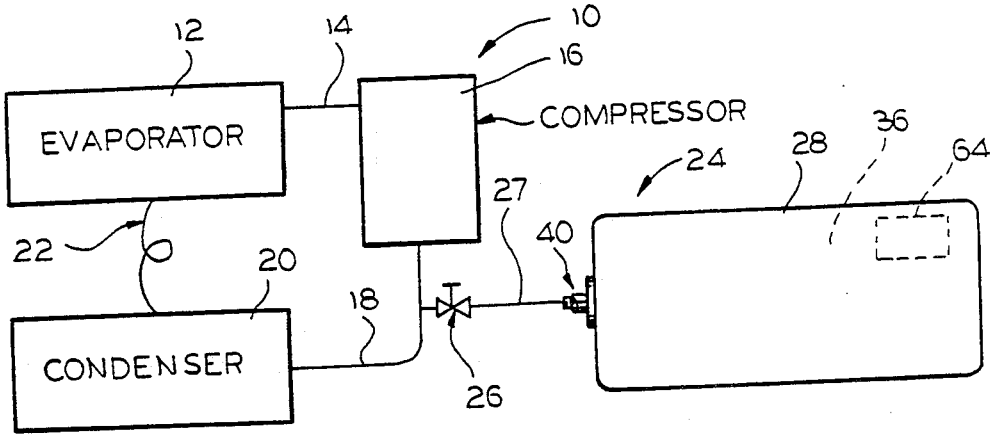
FIG. 1 is a schematic diagram of a system for capturing refrigerant from a home refrigeration system according to the invention.
Figure 5:
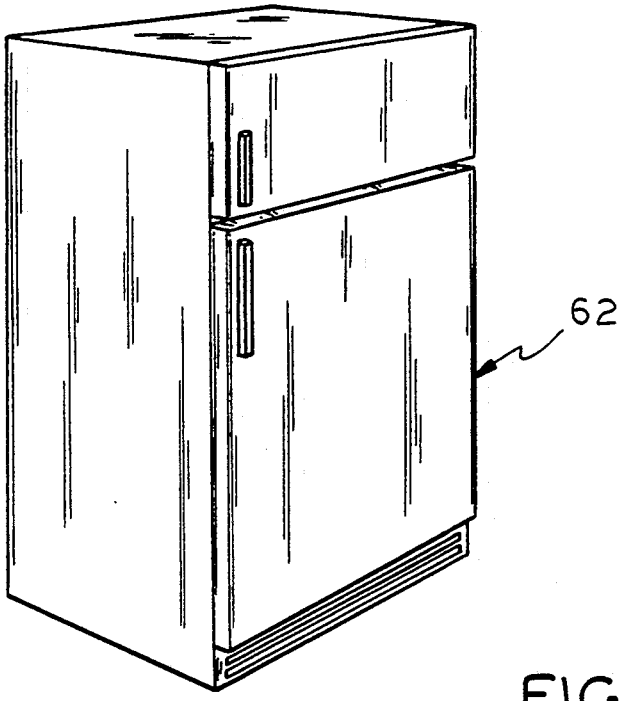
FIG. 5 is a perspective view of a refrigeration apparatus in the form of a refrigerator/freezer including a sealed pressurized refrigeration system.
Figure 6:
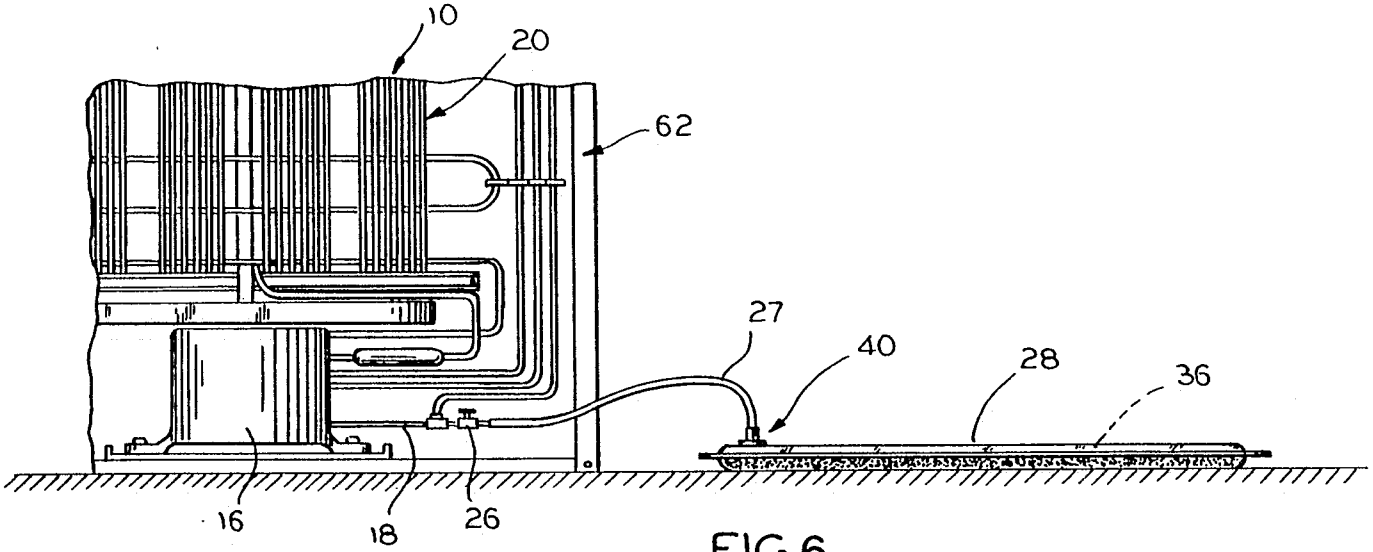
FIG. 6 is a rear elevational view of the refrigerator/-freezer of FIG. 5 illustrating the plastic bag of FIG. 2 in a generally unfilled state connected to the refrigerator/-freezer of FIG. 5 prior to the refrigerant capture process.
Figure 7:
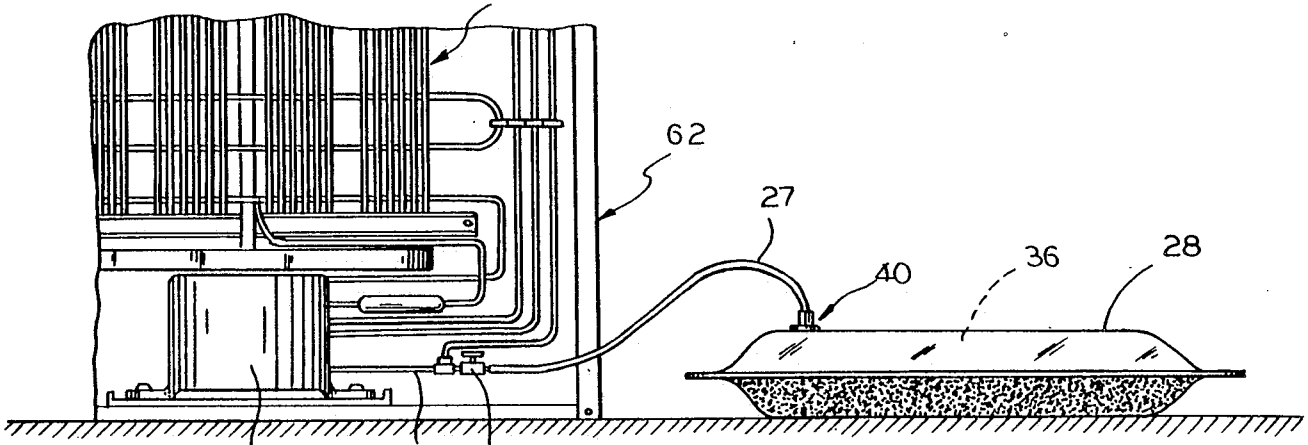
FIG. 7 is a rear elevational view of the refrigerator/-freezer apparatus of FIG. 5 illustrating the plastic bag of FIG. 2 in a generally partially filled state connected to the refrigerator/freezer during the capture process.

With reference to FIG. 1, a schematic diagram illustrates a servicing apparatus and method for capturing a refrigerant contained in a sealed, pressurized refrigeration system 10. The invention may be used in connection with a refrigeration apparatus, such as a refrigerator, freezer, dehumidifier or air conditioner, as will be obvious to those skilled in the art. In the illustrated embodiment, the apparatus and method is used in connection with a typical home refrigerator/freezer such as shown in FIGS. 5–7.

The sealed system 10 includes an evaporator 12 connected by a conduit 14 to a compressor 16. The compressor 16 is connected through a conduit 18 to a condenser 20 which, in turn, is connected through a capillary tube 22 to the evaporator 12.

The system 10 is sealed and under pressure, as is well known. The sealed system includes a conventional refrigerant or coolant such as R-12 for providing a refrigeration effect. Specifically, as is well known, the evaporator receives the refrigerant in liquid form which subsequently evaporates to remove heat from the surrounding area. The evaporated refrigerant is in a gas form. The compressor 16 pumps and pressurizes the refrigerant vapor from the relatively low pressure conduit 14 through the high pressure conduit 18 to the condenser 20. The high pressure and the cooling causes the vapor to condense back to liquid refrigerant for recirculation through the capillary tube 22 to the evaporator 12.

A system 24 is provided for removing and capturing the refrigerant from the refrigeration system 10. This operation may be necessary, for example, if there is a failure in the refrigeration system, if there is a low charge of refrigerant in the system 10, or if there is some restriction within the sealed system 10.

The recovery and capture system 24 includes an access valve 26, a flexible hose 27, and a refrigerant container in the form of a plastic bag, or pouch, 28 according to the invention.

The access valve 26 may be of any known form which can be installed on a refrigerant line such as the conduit 18 when the system is operable. Particularly, a conventional access valve 26 is brazed in the line with the conduit 18 and the conduit 18 is subsequently punctured to provide a connection between the valve 26 and the conduit 18. Alternatively, the access valve 26 could be preinstalled in the refrigeration system 10. Also, if a removal procedure has previously been performed on the refrigeration system 10, then an access valve would already be in place.

Figure 2:
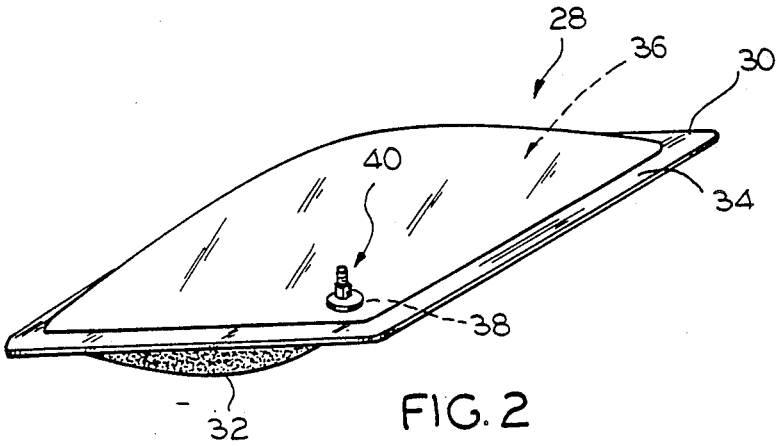
FIG. 2 is a perspective view of the refrigerant container portion of the apparatus of FIG. 1 for capturing the refrigerant and comprising a plastic bag or pouch according to the invention.
Figure 3:
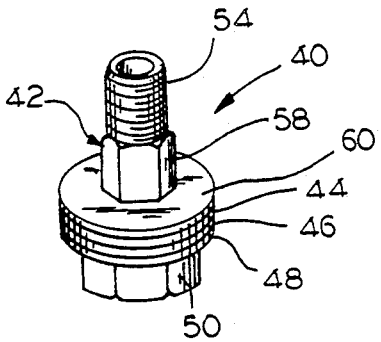
FIG. 3 is a perspective view of an adapter fitting of the plastic bag of FIG. 2.
Figure 4:
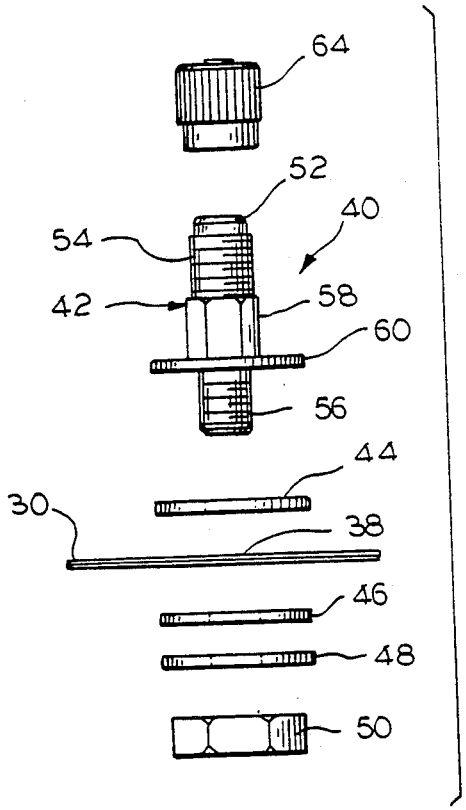
FIG. 4 is an exploded view illustrating how the adapter fitting of FIG. 3 is secured to the plastic bag.

With reference to FIG. 2, the bag 28 comprises a top sheet 30 and a bottom sheet 32, both sheets consisting of an assembly of multi-layer barrier film material. The sheets 30 and 32 are sealed together, using a heat sealing or other suitable sealing process, around a peripheral seal area, as at 34, to form a closed bag having an interior space 36. The barrier film material of each sheet 30 and 32 is specially formulated and fabricated to prevent outward permeation of a refrigerant contained in the space 36 and to prevent inward permeation of air into the space 36. Further, it is desirable that the sheets 30 and 32 be made of a material which is inexpensive, is maintained at low pressure for safety, permits visual examination of the contents of the refrigerant, and is reusable.

Figure 8:
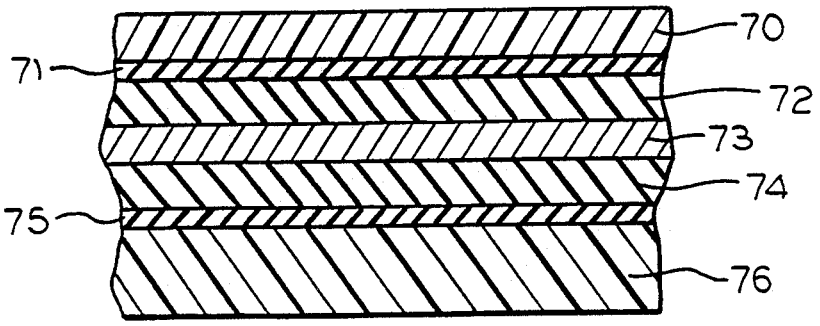
FIG. 8 is a view of a greatly enlarged wall portion of the plastic bag refrigerant container showing the various layers in on wall of the container.

One material found to be satisfactory for the indicated needs is a forming film sold by Cryovac Division of W. R. Grace Company under the designator T6040B. This forming film is of multi-layer construction a shown in FIG. 8 and includes the layers listed below and identified by the reference numerals shown in FIG. 8:

1. Oriented Polypropylene (Outer Layer 70)
2. Adhesive 71
3. Nylon 72
4. Ethylene Vinyl Alcohol Copolymer 73
5. Nylon 74
6. Adhesive 75
7. Linear Low Density Polyethylene Heat Seal Adhesive (Inner Layer 76)

The linear low density polyethylene heat seal adhesive layer 76 is inert to the CFCs in the refrigerant, to compressor oil which may be contained in the refrigerant, and to the contaminants which may be found in a failed sealed system. Any reaction or excessive adsorption of either the compressor oil or the refrigerant with the bag could cause failure and loss of the refrigerant to the atmosphere. The polyethylene also provides elasticity. If the bag is overfilled with refrigerant, then it must have the elasticity to expand rather than burst. The nylon layers 72, 74 provide toughness. Specifically, a degree of resistance against puncture is required, which resistance is provided by the nylon layers 72 and 74. Finally, the ethylene vinyl alcohol copolymer layer 73 provides a barrier to the diffusion of air. Diffusion of air into the refrigerant bag would make the purification of the refrigerant very difficult to perform.

In the illustrated embodiment, the upper sheet 30 is of transparent plastic, while the lower sheet 32 is of colored plastic material. Alternatively, both sheets 30 and 32, or at least a portion of one of them, could be of transparent plastic material. The use of the transparent material permits a serviceman to immediately visually analyze the contents of the refrigerant to determine the cause of the sealed system failure. For example, a burnt compressor failure will be evident by burnt compressor oil which is much darker in color and which can be seen through the transparent sheet 30.

An opening 38 is provided through the top sheet 30 for providing in inlet to the space 36. A filling adapter 40 is secured to the top sheet 30 at the opening 38 to form a bulkhead fitting with the bag 28.

The filling adapter 40 comprises a coupling element 42, first and second neoprene washers 44 and 46, an aluminum washer 48 and a hexnut 50. The coupling element 42 comprises an elongated tube 52 including a threaded outer end 54 and an opposite threaded inner end 56. The threaded inner end 56 is provided with a rounded or smoothed edge to prevent puncturing of the sheets 30 and 32. Disposed immediately inwardly of the threaded outer end 54 is a midportion 58 including flattened surfaces much as with a hexnut, for receiving a wrench, and having an inner flange 60, such as a washer. The coupling element 42 may be formed of aluminum, or other material as necessary or desired. In the illustrated embodiment, the coupling element 42 is of unitary construction. Alternatively, the coupling element could comprise a threaded tube receiving a hexnut and washer or comprise a threaded tube that is adhesively bonded or sealed to the sheet 30.

The filling adapter 40 is secured to the sheet 30 as by installing the first neoprene washer 44 on the coupling element inner end 56 so that it abuts the flange 60. The coupling element inner end is then inserted through the opening 38 in the first sheet 30 and it then receives the second neoprene washer 46 and the aluminum washer 48. Finally, the hexnut 50 is threadably secured to the coupling element threaded inner end 56 to provide a secure sealed connection. Preferably, the hexnut 50 also has rounded edges to prevent perforation of the sheets 30 and 32.

The refrigerant container 28 of the present invention is advantageous in that it is very light and easily handled. The bag or container 28, when empty, weighs approximately ½ lb. One tested container 28, of a capacity large enough to hold the refrigerant from three twenty cubic foot refrigerators, weighed less than four lbs. when full of captured refrigerant.

With reference to FIGS. 6 and 7, the use of the recovery and capturing system 24 and a method for capturing the refrigerant is generally illustrated.

Initially, a service technician installs the access valve 26 in the conduit 18 between the compressor 16 and the condenser 20 of a conventional domestic refrigerator/-freezer 62. The access valve 26 can be installed in the conduit 18 in any known manner, such as by brazing the valve 26 to the conduit 18 and thereafter puncturing the conduit 18, as is well known. With the valve 26 being closed, the flexible conduit 27 is connected to the valve 26 at one end with the other end being threadably connected to the outer threaded end 54 of the filling adapter coupling element 42. As such, a direct connection is provided between the compressor outlet high pressure conduit 18 and the interior space 36 of the bag 28, with the access valve 26 interposed therebetween.

Once the connection has been completed, then the access valve 26 is opened. Since the sealed system is under pressure owing to the operation of the compressor 16, the refrigerant in the sealed system 10 is caused to be pumped through access valve 26 and the flexible hose 27 into the interior space 36 of the bag 28. The bag 28 is initially in a generally flattened state, as illustrated in FIG. 5, and subsequently expands to a partially filled state, as illustrated in FIG. 6.

Once the refrigerant has transferred from the sealed system 10, then the access valve 26 is closed and the flexible hose 27 removed from the fitting adapter 40 and immediately a cap 84, containing a neoprene washer or o-ring **84*a*, is put on the fitting adapter 40, then the hose 27 is disconnected from the valve 26. Although the adapter fitting is temporarily opened, it has been found that due to the low pressure and weight of the refrigerant (five times the weight of air) contained in the space 36, little, if any, escapes into the atmosphere. The bag 28** is then ready for transfer to a recycling or disposal location.

In the illustrated embodiment, the access valve 26 is connected on the high side line of the compressor 24. If the compressor is inoperative, then an additional valve may be provided at the low side of the compressor which is used to cause the removal of the pressurized refrigerant.

Depending upon the location of the access valve 26, the refrigerant may be liquid or gas. However, if the refrigerant is liquid, then it will evaporate to a gas as it is exposed to atmospheric pressure.

In one embodiment which has been subjected to tests, the bag 28 utilizes sheets 30 and 32 which are rectangular in shape and are thirty-six inches wide by forty-eight inches long, with a heat seal being provided immediately adjacent the outer edges thereof. Such a bag is sufficient to hold twenty-eight ounces by weight of R-12 refrigerant at 140° F. This is sufficient volume to service a typical refrigerator/freezer sealed system and, in fact, can be used to service as many as three sealed systems.

The tested size is indicated for illustrative purposes, and is not limiting. However, it is desirable that the bag be of sufficient size to prevent against careless use by a technician. Particularly, if the bag is overfilled with refrigerant and liquid refrigerant is subsequently added, then the bag can break.

The use of the disclosed multi-barrier layered film material provides a bag which is safe for a user thereof and any observers. The bag is never more than one psi above atmospheric pressure. In tests, the use of the film material permits expansion to approximately 350% of bag volume prior to breakage. In fact, in tests arranged to provide extreme high pressure conditions, the bag 28 failed by biaxial extension, always remote from the heat seal area 34 or tube connection 40. The pressure goes through a peak after which the bag 28 is in a yielding mode and the pressure thus decreases. In view of the above, it is believed that it would be extremely difficult for a user under ordinary circumstances to overfill a bag 28 to the point of rupturing. Even if a fully loaded bag 28 is placed in a hot environment, the bag 28 will yield to swell further to accommodate the extra volume. Because the bag 28 is of such low pressure, it is not necessary to utilize a valve in the adapter fitting 40. In the referred to overpressure tests, rather than a violent explosion, only a soft "poof" is provided upon bag breakage.

By using the disclosed film material and fitting adapter 40, the bag 28 is relatively inexpensive, estimated at approximately $10.00 per unit. Thus, it can easily be afforded by small repair shops and service operations and it can be used in a safe and efficient manner to remove and capture refrigerants.

The use of the above-described system and method permits a technician to immediately take steps which are useful in the recycling and/or disposal of the refrigerant. As discussed above, the refrigerant purged into the bag 28 contains compressor oil and may include contaminants from the sealed system. In the bag 28, the refrigerant separates from the compressor oil and any possible contaminant. Thus, when the refrigerant is removed from the bag for recovery or disposal it can be done without the contaminants or compressor oil, thus providing initial purification of the refrigerant. In order to enhance additional steps of purification, a material, illustrated schematically at 64 in FIG. 1, can be inserted in the bag interior space 36, before or after the capturing of the refrigerant.

One of the major difficulties of purifying refrigerant is the removal of acidity. Acidity removal can be accomplished by using an alkali material. Therefore, according to one embodiment, the material 64 comprises an alkali material which is inserted into the bag. A typical such material is calcium hydroxide which would be effective to remove the acidity from the refrigerant which has been captured.

Another step in purifying the refrigerant is the removal of organic hydrocarbons. Thus, according to another embodiment of the invention the material 64 could comprise charcoal in some form which would remove some of the hydrocarbons from the refrigerant.

The oxygen in any air captured in the bag will in subsequent processing react and oxidize matter in the bag. According to a further embodiment of the invention, the material 64 can comprise an oxygen scavenger material such as an active iron powder package which removes the oxygen from the bag.

Finally, the material 64 may comprise a desiccant for removal of moisture from the refrigerant during a recovery and capture process.

Thus, in accordance with the invention, a simple and inexpensive apparatus and method is provided for recovering and capturing refrigerants from a sealed refrigeration system.

The foregoing disclosure is illustrative of the broad inventive concepts comprehended by the invention.

What is claimed is:

1. A method of capturing refrigerant contained in a sealed, pressurized refrigeration system, comprising the steps of:

attaching an access valve on a line of said system;

connecting a plastic bag to said access valve, said bag being at atmospheric pressure and of a material inert to the refrigerant and other contents of the sealed system;

opening said valve to permit said refrigerant to escape under pressure from said system to said bag and subsequently closing said access valve;

removing said bag from said access valve;

inserting an alkali material in said plastic bag to remove the acidity from the captured refrigerant; and sealing said bag to prevent the captured refrigerant from escaping.

2. A method of capturing refrigerant contained in a sealed, pressurized refrigeration system, comprising the steps of:

attaching an access valve on a line of said system;

connecting a plastic bag to said access valve, said bag being at atmospheric pressure and of a material inert to the refrigerant and other contents of the sealed system;

opening said valve to permit said refrigerant to escape under pressure from said system to said bag and subsequently closing said access valve;

removing said bag from said access valve;

inserting charcoal in said plastic bag to remove organic hydrocarbons from the captured refrigerant; and sealing said bag to prevent the captured refrigerant from escaping.

3. A method of capturing refrigerant contained in a sealed, pressurized refrigeration system, comprising the steps of:

attaching an access valve on a line of said system;

connecting a plastic bag to said access valve, said bag being at atmospheric pressure and of a material inert to the refrigerant and other contents of the sealed system;

opening said valve to permit said refrigerant to escape under pressure from said system to said bag and subsequently closing said access valve;

removing said bag from said access valve;

inserting an active metal such as iron in said plastic bag to remove oxygen from the captured refrigerant; and sealing said bag to prevent the captured refrigerant from escaping.

4. An apparatus for capturing refrigerant contained in a sealed, pressurized refrigeration system having a refrigerant line providing access to said system, comprising:

a plastic bag of a film material to define an interior space at atmospheric pressure, the film material being inert to the refrigerant and other contents of the sealed system;

an opening through said film material providing an inlet to said space;

an alkali material in the interior space of said plastic bag to remove any acidity from the captured refrigerant; and means for connecting said bag at the opening thereof to said sealed system to permit said refrigerant to escape under pressure from said refrigeration system to the interior space of said bag.

5. An apparatus for capturing refrigerant contained in a sealed, pressurized refrigeration system having a refrigerant line providing access to said system, comprising:

a plastic bag of a film material to define an interior space at atmospheric pressure, the film material being inert to the refrigerant and other contents of the sealed system;

an opening through said film material providing an inlet to said space;

charcoal in the interior space of said plastic bag to remove organic hydrocarbons from the captured refrigerant; and means for connecting said bag at the opening thereof to said sealed system to permit said refrigerant to escape under pressure from said refrigeration system to the interior space of said bag.

6. An apparatus for capturing refrigerant contained in a sealed, pressurized refrigeration system having a refrigerant line providing access to said system, comprising:

a plastic bag of a film material to define an interior space at atmospheric pressure, the film material being inert to the refrigerant and other contents of the sealed system;

an opening through said film material providing an inlet to said space;

an active metal such as iron in the interior space of said plastic bag to remove oxygen from the captured refrigerant; and means for connecting said bag at the opening thereof to said sealed system to permit said refrigerant to escape under pressure from said refrigeration system to the interior space of said bag.

7. An apparatus for capturing refrigerant contained in a sealed, pressurized refrigeration system having a refrigerant line providing access to said system, comprising:

a plastic bag of a film material to define an interior space at atmospheric pressure, the film material being inert to the refrigerant and other contents of the sealed system, said bag comprising a laminate sheet material having layers of polyethylene, nylon and ethyl vinyl alcohol copolymer;

an opening through said film material providing an inlet to said space; and means for connecting said bag at the opening thereof to said sealed system to permit said refrigerant to escape under pressure from said refrigeration system to the interior space of said bag.

8. An apparatus for capturing refrigerant contained in a sealed, pressurized refrigeration system having a refrigerant line providing access to said system, comprising:

a plastic bag of a film material to define an interior space at atmospheric pressure, the film material being inert to the refrigerant and other contents of the sealed system, said bag comprising a laminate sheet material having successive layers of oriented polypropylene, an adhesive, nylon, ethylene vinyl alcohol copolymer, nylon, and linear low density polyethylene heat seal adhesive;

an opening through said film material providing an inlet to said space; and means for connecting said bag at the opening thereof to said sealed system to permit said refrigerant to escape under pressure from said refrigeration system to the interior space of said bag.

9. A system for capturing refrigerant contained in a sealed, pressurized refrigeration system comprising:

an access valve for connection in a line of said refrigeration system;

a plastic bag made of sheets of laminate film material heat sealed together to define an interior space at atmospheric pressure, the film material being inert to the refrigerant, compressor oil and sealed system contaminants;

an opening through one of said sheets providing an inlet to said space;

an adapter fitting secured to said film at the opening;

a flexible hose for connecting said adapter fitting to said access valve to permit said refrigerant to escape under pressure from said refrigeration system to the interior space of said bag; and an alkali material in the interior space of said plastic bag to remove the acidity from the captured refrigerant.

10. A system for capturing refrigerant contained in a sealed, pressurized refrigeration system comprising:

an access valve for connection in a line of said refrigeration system;

a plastic bag made of sheets of laminate film material heat sealed together to define an interior space at atmospheric pressure, the film material being inert to the refrigerant, compressor oil and sealed system contaminants;

an opening through one of said sheets providing an inlet to said space;

an adapter fitting secured to said film at the opening;

an active metal such as iron powder in the interior space of said plastic bag to remove oxygen from the captured refrigerant; and a flexible hose for connecting said adapter fitting to said access valve to permit said refrigerant to escape under pressure from said refrigeration system to the interior space of said bag.

11. A system for capturing refrigerant contained in a sealed, pressurized refrigeration system comprising:

an access valve for connection in a line of said refrigeration system;

a plastic bag made of sheets of laminate film material heat sealed together to define an interior space at atmospheric pressure, the film material being inert to the refrigerant, compressor oil and sealed system contaminants;

an opening through one of said sheets providing an inlet to said space;

an adapter fitting secured to said film at the opening;

charcoal in the interior space of said plastic bag to remove organic hydrocarbons from the captured refrigerant; and a flexible hose for connecting said adapter fitting to said access valve to permit said refrigerant to escape under pressure from said refrigeration system to the interior space of said bag.

12. A system for capturing refrigerant contained in a sealed, pressurized refrigeration system comprising:

an access valve for connection in a line of said refrigeration system;

a plastic bag made of sheets of laminate film material heat sealed together to define an interior space at atmospheric pressure, the film material being inert to the refrigerant, compressor oil and sealed system contaminants, said sheets comprising a laminate film material having layers of polypropylene, an adhesive, nylon and ethylene vinyl alcohol copolymer;

an opening through one of said sheets providing an inlet to said space;

an adapter fitting secured to said film at the opening; and a flexible hose for connecting said adapter fitting to said access valve to permit said refrigerant to escape under pressure from said refrigeration system to the interior space of said bag.

13. A system for capturing refrigerant contained in a sealed, pressurized refrigeration system comprising:

an access valve for connection in a line of said refrigeration system;

a plastic bag made of sheets of laminate film material heat sealed together to define an interior space at atmospheric pressure, the film material being inert to the refrigerant, compressor oil and sealed system contaminants, said sheets comprising a laminate film material having successive layers of oriented polypropylene, adhesive, nylon, ethylene vinyl alcohol copolymer, nylon, adhesive, and linear low density polyethylene heat seal adhesive;

an opening through one of said sheets providing an inlet to said space;

an adapter fitting secured to said film at the opening; and a flexible hose for connecting said adapter fitting to said access valve to permit said refrigerant to escape under pressure from said refrigeration system to the interior space of said bag.

* * * * *